US005606817A

United States Patent [19]

Sachse

[11] Patent Number: 5,606,817

[45] Date of Patent: Mar. 4, 1997

[54] MUZZLE-LOADING FIREARM

[75] Inventor: Troi N. Sachse, Elizabethtown, Ky.

[73] Assignee: Remington Arms Company, Inc.

[21] Appl. No.: 544,928

[22] Filed: Oct. 18, 1995

[51] Int. Cl.[6] ..... F41C 9/08

[52] U.S. Cl. ..... 42/51; 89/1.3

[58] Field of Search ..... 42/51, 69.02; 89/1.3, 89/27.13

[56] References Cited

U.S. PATENT DOCUMENTS

| | | | |
|---|---|---|---|
| 1,226,566 | 5/1917 | Moore | 42/69.02 |
| 1,693,530 | 11/1928 | Spencer | 42/69.02 |
| 2,514,981 | 7/1950 | Walker et al. | 42/70.01 |
| 3,631,620 | 1/1972 | Ohira | 42/69.02 |
| 3,757,447 | 9/1973 | Rowe | 42/51 |
| 4,700,499 | 10/1987 | Knight | 42/51 |
| 5,408,776 | 4/1995 | Mahn et al. | 42/51 |

FOREIGN PATENT DOCUMENTS

| | | | |
|---|---|---|---|
| 322806 | 11/1934 | Italy | 89/1.3 |

*Primary Examiner*—Stephen M. Johnson
*Attorney, Agent, or Firm*—Donald W. Huntley

[57] ABSTRACT

An in-line muzzle-loading firearm in which the firing pin is cocked by a bolt action permits the use of a stronger firing pin spring, reduced mass firing pin, and reduced firing pin travel, resulting in reduced lock times.

8 Claims, 3 Drawing Sheets

MUZZLE-LOADING FIREARM

BACKGROUND OF THE INVENTION

This invention relates generally to firearms and more particularly, to muzzle loading firearms with an improved ignition system.

Hunting with muzzle loading firearms has become increasingly popular. Reasons for this popularity include the enjoyment of manually loading the powder and projectile into the muzzle, and then packing it with the ramrod. As evidence of the increasing popularity of muzzle loading firearms, some states have separate hunting seasons for sportsmen with muzzle loading firearms. Despite their increased popularity, muzzle loading firearms have presented several problems to those that use them. The most important problem associated with previous muzzle loading firearms relates to the accuracy of the weapon, a paramount concern to the user. The accuracy of a weapon is inversely related to, inter alia, the lock time of the weapon. Lock time is measured from the time the trigger is squeezed until the powder charge launching the projectile actually fires. Even minute delays in the lock time cause inaccuracies due to the difficulty of holding the weapon still over increased periods of time. Thus, developments that tend to decrease lock time increase the functionality of the weapon by increasing the weapon's accuracy.

In response to the problem of accuracy, muzzle loading firearms have been modified over the years. In the original flintlock muzzle-loading rifles, the flint was mounted on a traditional swing hammer, which, when released by the trigger, struck a frizzen, producing a spark which ignited the primer charge in a pan. The detonation of the primer charge was carried though a flash hole to the main charge in the barrel, causing the powder which was loaded through the muzzle to explode, thereby propelling the projectile. Later developments involved the replacement of the pan with a self contained primer charge or percussion cap, which was struck directly by the hammer, and the resulting detonation charge was similarly carried to the main charge in the barrel.

Mechanisms previously used for initiating such impact sensitive primer charges involved a spring loaded hammer or firing pin which was positioned on either the top or side of the firearm. More recently, in-line muzzle-loading rifles were developed, in which an impact sensitive primer or percussion cap, connected to the barrel by a flash hole, is detonated by an in-line striker. Such strikers are drawn back manually, as illustrated, for example, in Mahn et al., U.S. Pat. No. 5,408,776.

Despite the advances that have been made over the decades, a continuing need exists for a cocking and firing mechanism for muzzle loading firearms that provides a combination of ease of cocking with minimization of the lock time of the firearm upon firing.

SUMMARY OF THE INVENTION

The present invention provides an improved muzzle-loading firearm which combines mechanically assisted cocking and markedly reduced lock times compared to previously available mechanisms.

Specifically, the instant invention provides a muzzle-loading firearm comprising a barrel having a front end and a closed rear end and attached to a receiver; means at the rear end of the barrel for receiving a percussion cap; a flash hole formed in the rear end of the barrel; a bolt assembly having a front and a rear end and positioned within the receiver behind and substantially aligned with the barrel, the bolt assembly being operatively connected to a trigger assembly and comprising a bolt body, a firing pin within the bolt body, a spring positioned to bias the firing pin forward, a firing pin head at the rear end of the firing pin positioned to connect the firing pin to the trigger assembly, and a bolt plug at the rear end of the bolt to retain the firing pin; a first cam cut formed in the side of the bolt body having a forward longitudinal section and rearwardly extending transverse section; a cam follower in the receiver positioned to engage the first cam cut; a second cam cut in the rear of the bolt body to engage with the firing pin head for cocking the firing pin; and a bolt handle mounted on the bolt body for movement of the bolt assembly longitudinally and rotationally within the receiver and guided by the cam follower interacting with the first cam cut.

DETAILED DESCRIPTION OF THE INVENTION

Figure 2:
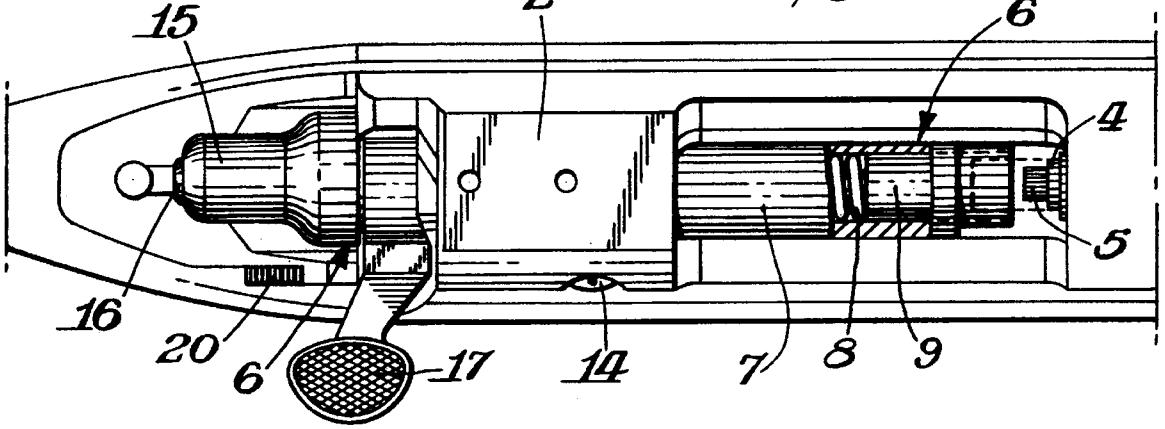
FIG. 2 is a fragmental top plan view of a firearm of the invention of FIG. 1 and partially broken away.
Figure 1:
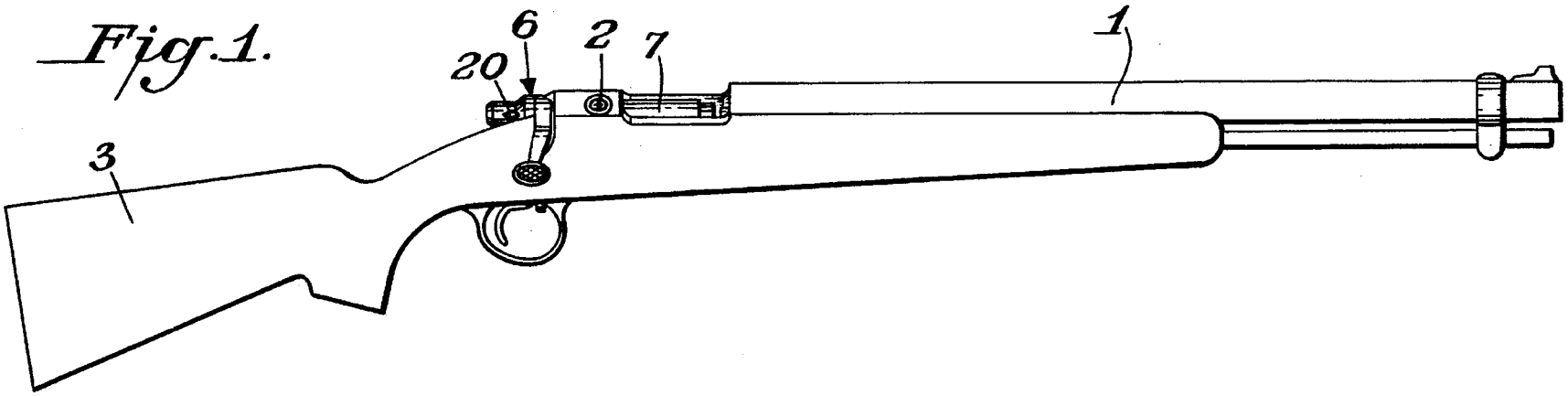
FIG. 1 is a side elevational view of a firearm of the invention, with the bolt in the closed position and cocked.

The present invention will be more fully understood by reference to the drawings, in which FIG. 1 is a side elevational view of a firearm of the invention, with the bolt assembly in the closed position and cocked. FIG. 2 is a fragmental top plan view of the firearm of FIG. 1, partially broken away to show the firing pin spring of firing pin inside the bolt body, with the bolt assembly in the closed and cocked position. In these figures, the firearm comprises barrel 1, attached to receiver 2, both of which are encased in stock 3. The rearward end of the barrel is closed with breech plug 4, having nipple 5 for engagement with a percussion cap, not shown. Bolt assembly 6, comprises bolt body 7 and contains firing pin spring 8 and firing pin 9. Cam follower 14 is inserted into the receiver to interact with the first cam cut in the bolt body to restrict and guide the motion of the bolt assembly 6 in its longitudinal and transverse motion in cocking the firearm. Bolt plug 15, at the rear end of the bolt assembly 6, serves to retain the firing pin 9 and the firing pin spring 8. The bolt assembly 6 is cocked and retracted by use of the bolt handle 17, which is mounted to the bolt body 7.

Figure 3:
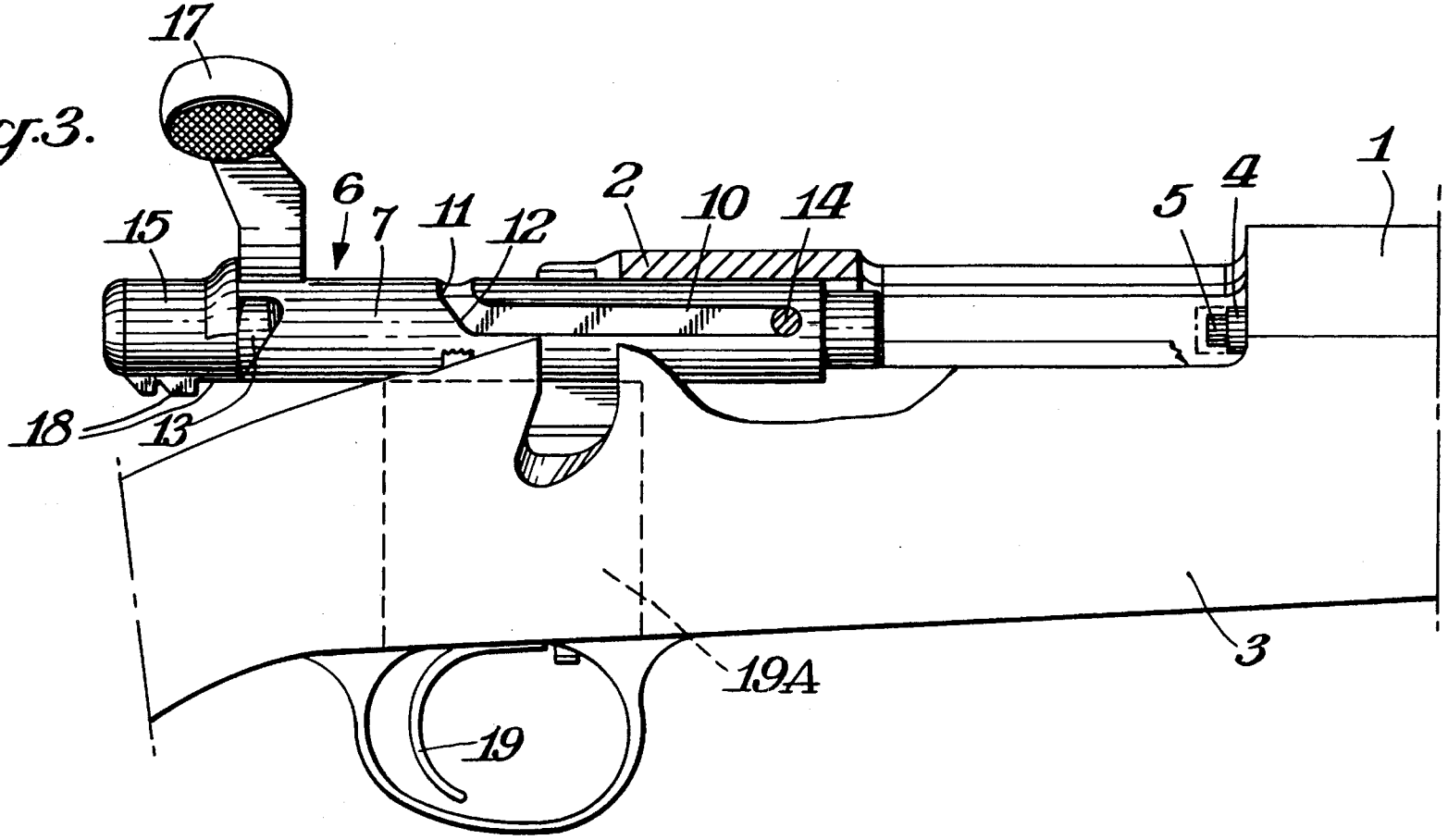
FIG. 3 is a fragmental side view of a firearm of the invention, partially broken away to show the operating mechanism with the bolt fully retracted.

FIG. 3 is a fragmental side view of the bolt assembly 6 fully retracted. The bold body 7 has cam cuts formed therein, a first in the side and a second in the rear. The first cam cut comprises longitudinal section 10, connected to transverse section 11 by angular or arcuate section 12. The transverse section of the first cam cut 11 serves a locking function when the bolt assembly 6 is in the fully closed position. The second cam cut 13 interacts with the firing pin head 16 to cock the firing pin 9 upon rotation of the bolt handle 17 after firing. The firing pin head 16, at the rear end of the firing pin 9, comprises projections 18, which engage the trigger assembly, generally indicated as 19A, second and which interact with the cam cut 13 to cock the firing pin 9. The firing pin head projections 18 also serve to release the firing pin 9 upon activation of the trigger assembly. The trigger assembly, while not central to the present invention, typically comprises trigger 19, safety 20, and sear, not shown. The trigger assembly which can be used includes, for example, that shown in Walker et al., U.S. Pat. No. 2,514,981, or that used on the Remington Model 700 Rifle, commercially available from the Remington Arms Company, Inc.

Figure 4:
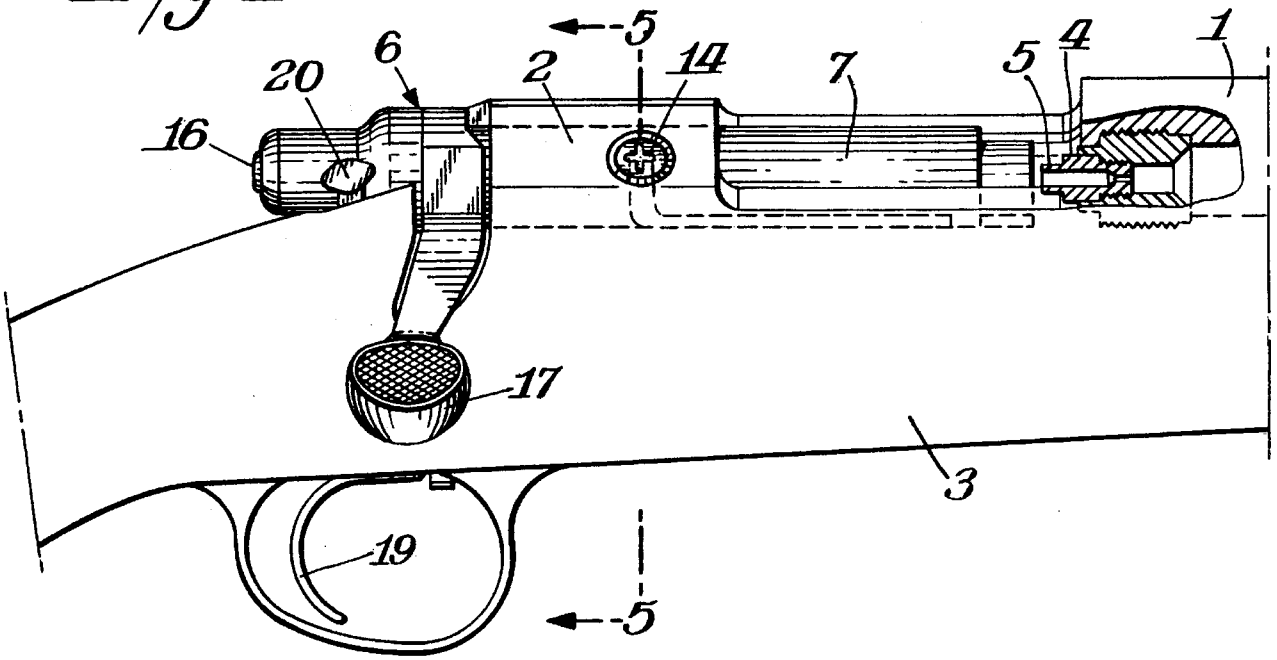
FIG. 4 is a fragmental side view of a firearm of the invention, partially broken away with the bolt assembly closed.

FIG. 4 is a fragmental side elevational view of the firearm, partially broken away. It shows the bolt assembly 6, the bolt body 7, the bolt handle 17, and the cam follower 14.

Figure 5:
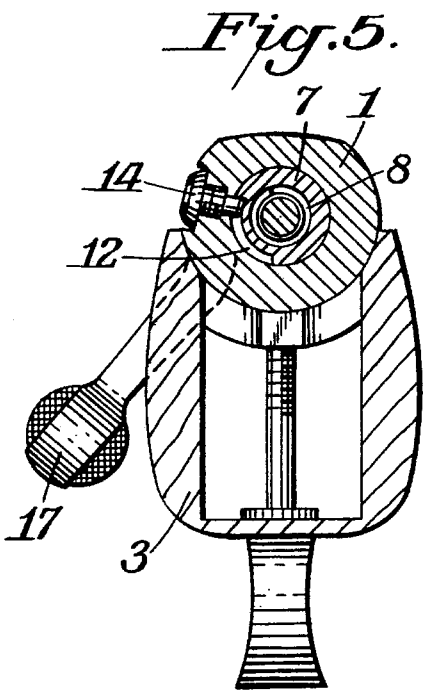
FIG. 5 is a cross sectional and elevational view of a firearm of the invention, taken at section 5—5 of FIG. 4.

FIG. 5 is a cross sectional and elevational view of the firearm, showing the positioning of the cam follower 14.

Figure 6:
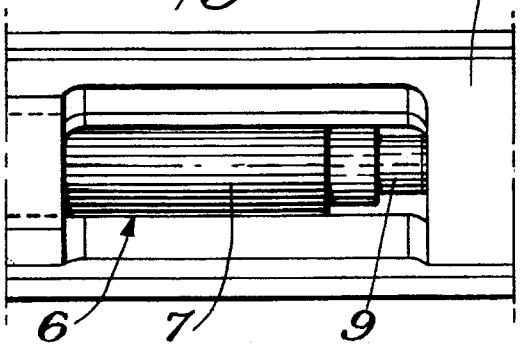
FIG. 6 is a fragmental top plan view of a firearm of the invention showing the bolt body and firing pin in the fired position.

FIG. 6 is a fragmental top plan view of the firearm, showing the bolt assembly 6 and firing pin 9 in the fired position. This figure shows the position of the firing pin 9 when it is fully extended to the limits as defined by the interaction of the second cam cut 13 the firing pin head 16. In this position, the firing pin 9 extends forward towards the nipple for engagement with a percussion cap, not shown, which fits over the nipple. While the firing pin 9 has moved forward in this figure, the hollow bolt assembly 6 has remained in the same position, so that the firing pin 9 extends beyond the bolt assembly 6.

The improved mechanism of the present invention provides a desirable combination of advantages. Specifically, the mechanically assisted cocking mechanism, through the combination of the handle operation of the bolt assembly, the interaction of the cam follower and the transverse section of the first cam cut, and the interaction of the firing pin head and the second cam cut, markedly increases the ease and speed with which the firearm can be cocked. This, in turn, enables the use of a substantially higher strength firing pin spring and a firing pin having a lighter mass. With the higher strength spring for the firing pin, the firing pin can be positioned closer to the percussion cap and can be of a lesser mass than has been possible with prior mechanisms, thus decreasing the lock time upon firing.

I claim:

1. A muzzle-loading firearm comprising a barrel having a front end and a closed rear end and attached to a receiver; means at the rear end of the barrel for receiving a percussion cap; a flash hole formed in the rear end of the barrel; a bolt assembly having a front and a rear end and positioned within the receiver behind and substantially aligned with the barrel, the bolt assembly being operatively connected to a trigger assembly and comprising a bolt body, a firing pin within the bolt body, a spring positioned to bias the firing pin forward, a firing pin head at the rear end of the firing pin positioned to connect the firing pin to the trigger assembly, and a bolt plug at the rear end of the bolt to retain the firing pin; a first cam cut formed in the side of the bolt body having a forward longitudinal section and rearwardly extending transverse section; a cam follower in the receiver positioned to engage the first cam cut; a second cam cut in the rear of the bolt body to engage with the firing pin head for cocking the firing pin; and a bolt handle mounted on the bolt body for movement of the bolt assembly longitudinally and rotationally within the receiver and guided by the cam follower interacting with the first cam cut.

2. A firearm of claim 1 wherein the cam follower is in the side of the receiver.

3. A firearm of claim 1 wherein the transverse section of the first cam cut extends rearwardly to a final section substantially perpendicular to the axis of the bolt.

4. A firearm of claim 3 wherein the transverse section of the first cam cut has a transitional section extending at an angle connecting with the final section.

5. A firearm of claim 3 wherein the transverse section of the first cam cut has a transitional section extending arcuately connecting with the final section.

6. A firearm of claim 1 wherein the receiver has an opening for receiving the percussion cap and the cam follower is rearward of the opening.

7. A firearm of claim 1 wherein the firing pin head comprises at least one projection for operative engagement with the trigger assembly.

8. A firearm of claim 1 wherein the second cam cut interacts with the firing pin head projection to define and restrict the movement of the firing pin, and cocks the firing pin upon rotation of the bolt assembly after firing.

* * * * *

US005606817B1

REEXAMINATION CERTIFICATE (3796th)

United States Patent [19] [11] B1 5,606,817

Sachse [45] Certificate Issued Jun. 29, 1999

[54] MUZZLE-LOADING FIREARM

[75] Inventor: Troi N. Sachse, Elizabethtown, Ky.

[73] Assignee: Remington Arms Company, Inc., Wilmington, Del.

Reexamination Request:
No. 90/005,070, Aug. 13, 1998

Reexamination Certificate for:

| | |
|---|---|
| Patent No.: | **5,606,817** |
| Issued: | **Mar. 4, 1997** |
| Appl. No.: | **08/544,928** |
| Filed: | **Oct. 18, 1995** |

[51] Int. Cl.[6] ..... F41C 9/08
[52] U.S. Cl. ..... 42/51; 89/1.3
[58] Field of Search ..... 42/51, 69.02, 16; 89/1.3, 27.13

[56] References Cited

U.S. PATENT DOCUMENTS

| | | | |
|---|---|---|---|
| 1,226,566 | 5/1917 | Moore | 42/69.02 |
| 1,693,530 | 11/1928 | Spencer | 42/69.02 |
| 2,514,981 | 7/1950 | Walker et al. | 42/70.01 |
| 3,330,061 | 7/1967 | Koon, Jr. | 42/16 |
| 3,631,620 | 1/1972 | Ohira | 42/69.02 |
| 3,745,686 | 7/1973 | Koon, Jr. | 42/16 |
| 3,757,447 | 9/1973 | Rowe | 42/51 |
| 4,015,357 | 4/1977 | Andersson | 42/16 |
| 4,700,499 | 10/1987 | Knight | 42/51 |
| 4,715,139 | 12/1987 | Rodney, Jr. | 42/51 |
| 4,920,677 | 5/1990 | Schuerman | 42/16 |
| 5,408,776 | 4/1995 | Mahn et al. | 42/51 |

FOREIGN PATENT DOCUMENTS

| | | | |
|---|---|---|---|
| 322806 | 11/1934 | Italy | 89/1.3 |

OTHER PUBLICATIONS

"The Remington 700", published by John F. Lacy, 1989.

*Primary Examiner*—Stephen M. Johnson

[57] ABSTRACT

An in-line muzzle-loading firearm in which the firing pin is cocked by a bolt action permits the use of a stronger firing pin spring, reduced mass firing pin, and reduced firing pin travel, resulting in reduced lock times.

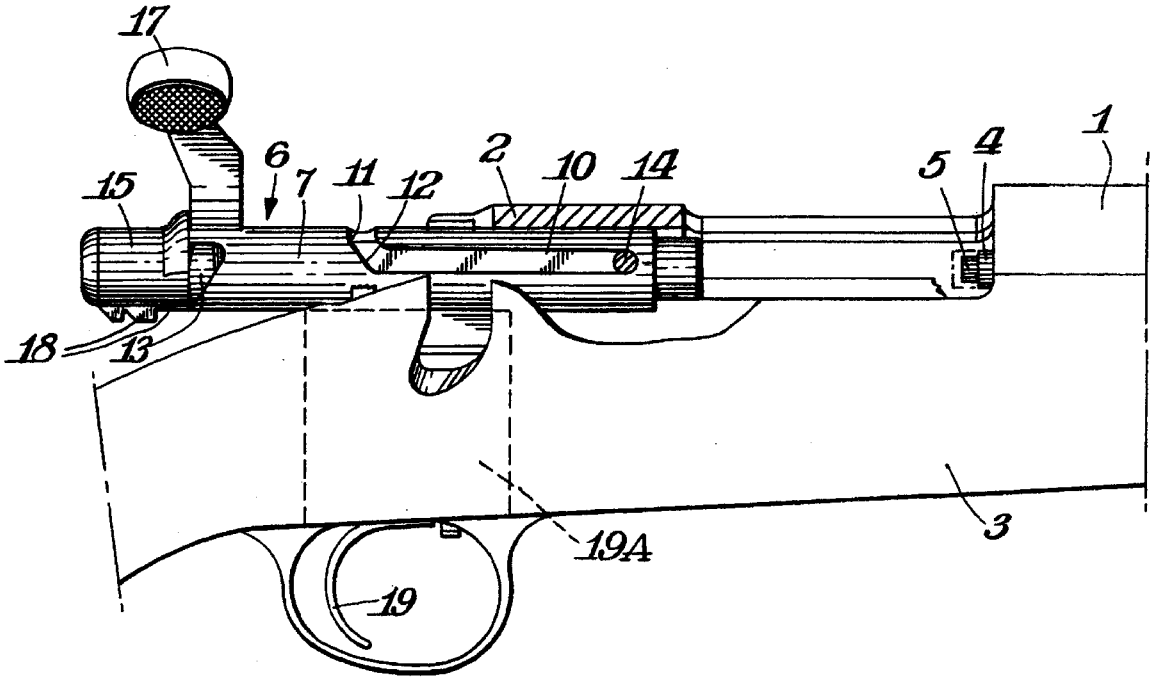

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *